United States Patent [19]

Rand

[11] Patent Number: 4,625,150

[45] Date of Patent: Nov. 25, 1986

[54] ELECTRON BEAM CONTROL ASSEMBLY FOR A SCANNING ELECTRON BEAM COMPUTED TOMOGRAPHY SCANNER

[75] Inventor: Roy E. Rand, Palo Alto, Calif.

[73] Assignee: Imatron, Inc., San Francisco, Calif.

[21] Appl. No.: 600,464

[22] Filed: Apr. 16, 1984

[51] Int. Cl.[4] ..... H01J 29/84

[52] U.S. Cl. ..... 315/111.31; 313/424; 313/426; 313/445

[58] Field of Search ..... 315/111.31; 313/424, 313/426, 432, 439, 445; 378/901

[56] References Cited

U.S. PATENT DOCUMENTS

| | | | |
|---|---|---|---|
| 2,921,212 | 1/1960 | Berthold | 313/424 |
| 4,075,533 | 2/1978 | Janko | 313/424 X |
| 4,155,028 | 5/1979 | Stolte | 313/424 X |

*Primary Examiner*—David K. Moore
*Assistant Examiner*—Vincent DeLuca
*Attorney, Agent, or Firm*—Flehr, Hohbach, Test, Albritton & Herbert

[57] ABSTRACT

An improved ion clearing electrode assembly for use in an electron beam production and control assembly which is especially suitable for use in a scanning electron beam computed tomography X-ray scanning system. The assembly uses a vacuum sealed housing chamber which is evacuated of internal gases and in which the electron beam is generated and propagated. Normally residual gas within the chamber interacts with the electrons of the beam to produce positive ions which have the affect of neutralizing the space charge of the electron beam and thereby causing focusing difficulties and destabilization of the beam. The ion collecting electrodes herein are an improvement of those disclosed in the co-pending Rand U.S. patent application Ser. No. 434,252, now U.S. Pat. No. 4,521,900. The electrodes are designed to extract the ions and reduce their neutralizing effect while maintaining a precisely uniform electric field and therefore beam optical aberrations are minimized. In addition, the electrode provides flexibility in the variation of parameters which effect ion extraction and the neutralization fraction.

19 Claims, 7 Drawing Figures

ELECTRON BEAM CONTROL ASSEMBLY FOR A SCANNING ELECTRON BEAM COMPUTED TOMOGRAPHY SCANNER

The present invention relates to electron beam apparatus and techniques which are suitable for producing X-rays in a tomographic X-ray transmission system of the type disclosed in U.S. Pat. No. 4,352,021, filed Jan. 7, 1980, in the name of BOYD ET AL and to an electron beam control assembly for such a scanning system which assembly is of the type introduced in co-pending U.S. patent application Ser. No. 434,252, filed Oct. 14, 1982, in the name of RAND now U.S. Pat. No. 4,521,900. The Boyd et al patent and the Rand patent are hereby incorporated by reference. The present invention also relates to an improved ion clearing electrode assembly and its associated operation in trapping and removing ions which are detrimental to the desired beam optics, while providing a uniform electric field. As a result, beam optics which are free of aberrations are maintained. In a related aspect, the dimensions and the electrode voltage of the ion clearing electrode assembly are used to control the neutralization fraction and provide a small neutralization fraction. In particular, the length of the ion clearing electrode assembly along the axis of the electron beam envelope may be used to impart a desired small value to the neutralization fraction using relatively low values of the electrode voltage.

FIG. 1 of the drawings is a schematic representation of a computed tomographic X-ray transmission scanning system 10 of the type treated in the Boyd et al patent and the co-pending Rand patent and thus needs only brief discussion here. The system 10 is divided into three major functional components: an electron beam production and control assembly 12, detector array 14 and a data acquisition and computer processing component (not shown) which does not relate to the present invention. Referring also to FIG. 2, the present invention is primarily concerned with the apparatus and functioning of the electron beam production and control assembly 12. This assembly includes a housing 26 which defines an elongated, vacuum sealed chamber 28 extending between rearward end 16 and forward end 20 of the system. The housing is divided into three co-axial sections: a rearwardmost chamber section 34, an intermediate control chamber section 36 and a forwardmost section 38. The overall chamber is evacuated of internal gases by means such as a conventional vacuum pump indicated generally at 40. Electron gun 42 is located proximate the rearward end 16 in chamber section 34 for producing a continuously expanding electron beam 44 and for directing the beam through chamber section 34 to control chamber 36. The intermediate control chamber section 36 bends the electron beam 44 through the forward section 38 of the assembly in a scanning manner and focuses it onto a cooperating arrangement of targets 50 for the purpose of generating X-rays. In particular, control chamber section 36 includes focusing coils 46 and deflecting coils 48 which bend the incoming beam from section 34 into forwardmost chamber section 38. At the same time, the coils focus the beam to a beam spot which is intercepted at the X-ray targets 50 located at the forward end 20 of chamber section 38. X-rays are produced when the electrons strike the targets and are detected by the detector array 14 for producing resultant output data which is applied to the computer processing arrangement as indicated by the arrow 22, FIG. 1, for processing and recording the data. The computer arrangement also includes means for controlling the electron beam production and control assembly 10 as indicated by arrow 24, FIG. 1.

The size of the focused beam at the X-ray targets 50 should be as small as possible. However, since this size depends inversely on the size of the beam 44 at the focusing coils 46 and deflecting coils 48, the cross-sectional size of the beam at these coils should be as large as possible. In addition, the configuration of the beam spot on the target 50 (its shape and orientation) must be accurately and reliably controlled.

As stated above, the overall chamber 28 is evacuated of internal gases, one primary purpose being to avoid beam neutralization. However, small amounts of residual gas such as nitrogen, oxygen, water, carbon dioxide, hydrocarbons and metal vapors inevitably remain. Since residual gas is present within the chamber, the electron beam will interact with it to produce positive ions which have the effect of neutralizing the space charge of the electron beam. To the extent the electron beam is neutralized to any appreciable degree between the electron gun 42 and the coils 46 and 48, it will tend not to expand, thereby reducing its size at the focusing and deflecting coils and increasing the minimum size of the beam spot which is focused on the X-ray target 50. Furthermore, neutralization if uncontrolled can adversely affect the stability and control of the beam, causing the beam to become unstable, and the magnetic field generated by the beam itself can ultimately cause the beam to collapse.

As described in the co-pending Rand U.S. patent, applicant has found it desirable, for mechanical reasons, to use a progressively outwardly stepped cylindrical configuration for chamber section 34. These steps produce minima or wells in the potential which is due to the space charge of the beam, along the beam axis. Biased ion clearing electrodes are positioned at the potential wells so that the beam-neutralizing positive ions are attracted to the potential minima and extracted therefrom by the ion clearing electrodes. These ion clearing electrodes introduced in the co-pending Rand U.S. patent have proven very successful in that they effectively remove beam-neutralizing positive ions but they do not precisely maintain the inherent uniformity of current density which the beam possesses as it enters the electrodes. As discussed in detail subsequently, within these ion clearing electrodes field uniformity is maintained to within several percentage points across the beam cross-section. However, the field of use of the beam—medical diagnosis—and the fact that the diagnostic data which is derived from the electron beam is extremely sensitive to aberrations and is susceptible to any system error, make it highly desirable to eliminate these several percentage point variations in field uniformity if at all possible.

Because of the desirability of this goal of near-perfect beam optics, it is one object of the present invention to provide an improvement of the ion clearing electrodes introduced in the Rand patent which reduces and preferably entirely eliminates electron beam neutralization by removing positive ions from the beam while maintaining a uniform field within the ion clearing electrode structure and thereby not introducing aberrations into the beam optics.

Another object of the present invention is to provide an ion clearing electrode which functions in accordance with the above object to remove positive ions from the beam without disruption of the beam and in addition does so without unwanted deflection of the beam.

Still another object of the invention is to provide an improved ion clearing electrode which removes positive ions from the electron beam without disrupting the beam and is designed to provide a small-valued neutralization fraction at a modest applied voltage by increasing the length of the electrode.

Still another specific object of the present invention is to provide an axially elongated ion clearing electrode structure which is designed to cooperatively eliminate unwanted deflection of the electron beam and provide a small neutralization fraction which is characteristic of substantial elimination of positive ions.

In accordance with the present invention, improved ion clearing electrodes each substantially defining a cylinder periphery are positioned at the negative potential wells along the electron beam. In one embodiment of the present invention, the improved cylindrical ion clearing electrode structure comprises a pair of end rings and four lengthwise-extending cylinder sections which each span predetermined arcs of the cylinder periphery. The opposite, first and second cylinder sections are electrically isolated from one another and from the end rings and the third and fourth sections, and the resulting electrically separate entities are connected to different voltage levels to provide highly effective removal of positive ions from the electron beam and at the same time provide a uniform electric field across the cross-section of the beam envelope. In particular, the third and fourth cylinder sections define an average potential and axial potential of the desired level and the end rings confine the electric field to the electrode. The third and fourth cylinder sections each comprise 60° of arc to provide a precisely uniform electric field across the cross-section of the beam envelope.

Also in a preferred working embodiment, the third and fourth cylinder sections and the end rings are provided a predetermined same voltage level which establishes the average and on-axis potential and confines the electric field to the region inside the electrode.

In accordance with another embodiment of the present invention, the improved ion clearing electrode comprises two such cylinder assemblies which are aligned co-axially in tandem. Applicant has discovered that by interchanging the voltage connections of the first and second sections for the two cylinder assemblies, any beam deflections provided by the two assemblies cancel and the combined length of the two sections may be elongated or otherwise varied to provide a desired low value to the neutralization fraction. The beam deflections cancel for the same applied voltages provided the ratio of length to radius is the same for both assemblies.

These and other aspects of the invention will be discussed in more detail in conjunction with the drawings wherein.

Figure 1:
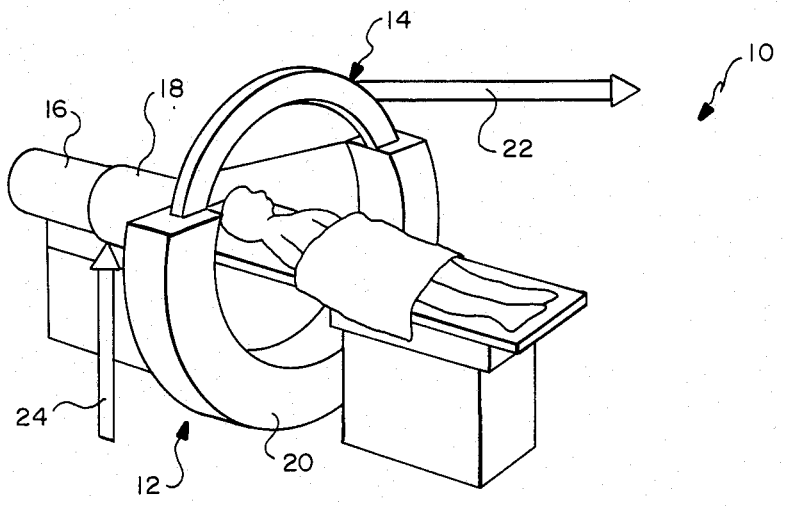
FIG. 1 is a schematic diagram partly in perspective showing a computed tomography X-ray transmission scanning system which utilizes an assembly for producing and controlling an electron beam within an evacuated beam chamber.
Figure 2:
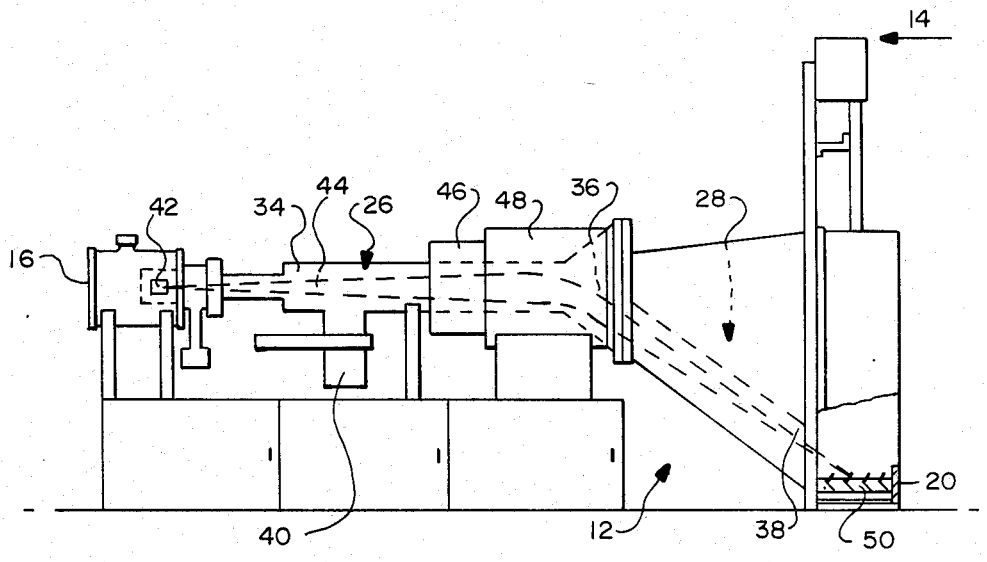
FIG. 2 is a longitudinal sectional view of the system shown in FIG. 1.
Figure 3:
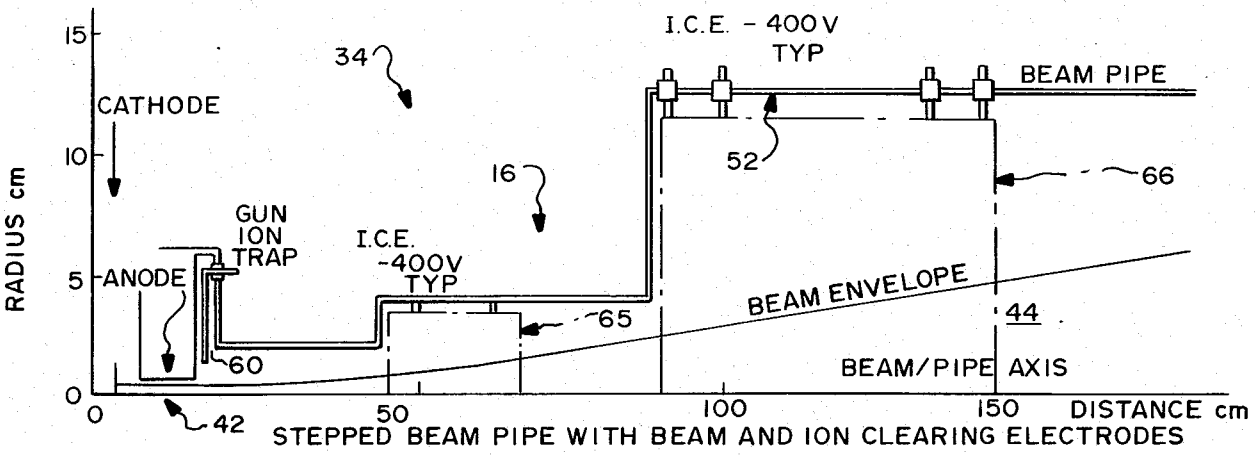
Figure 4:
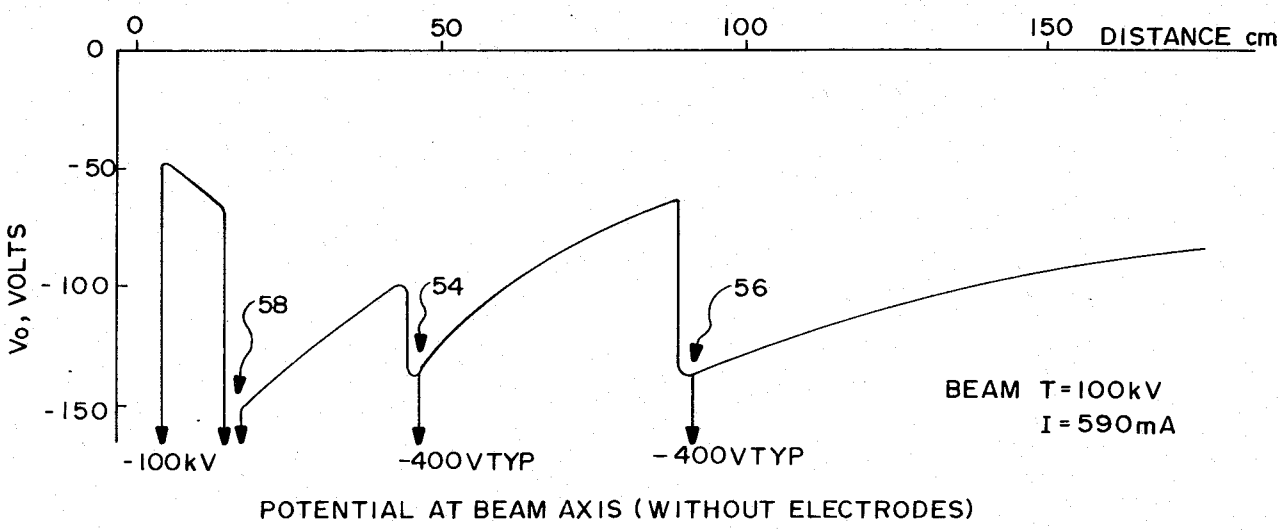
Figure 5:
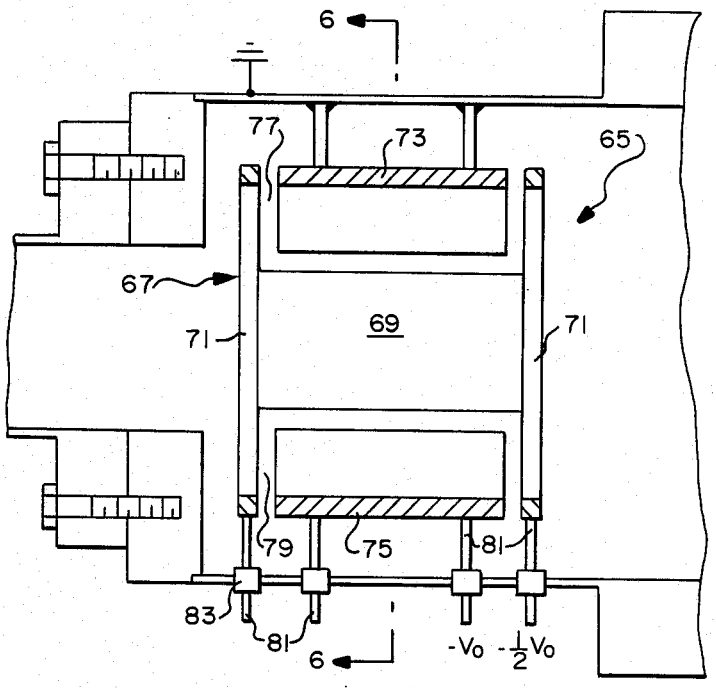
Figure 6:
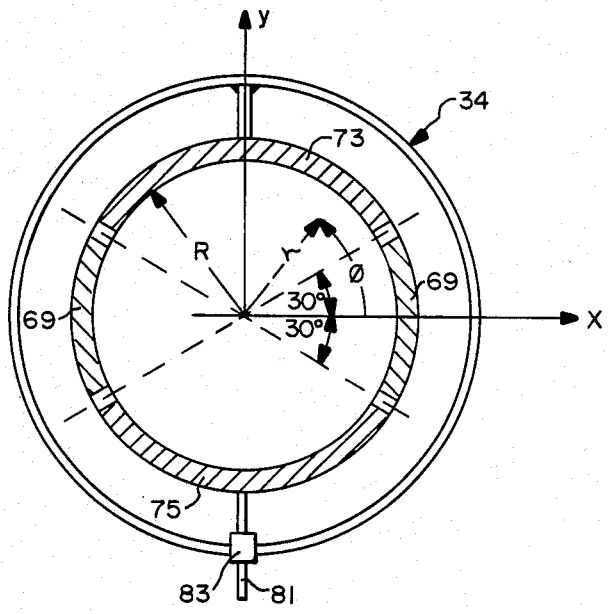
Figure 7:
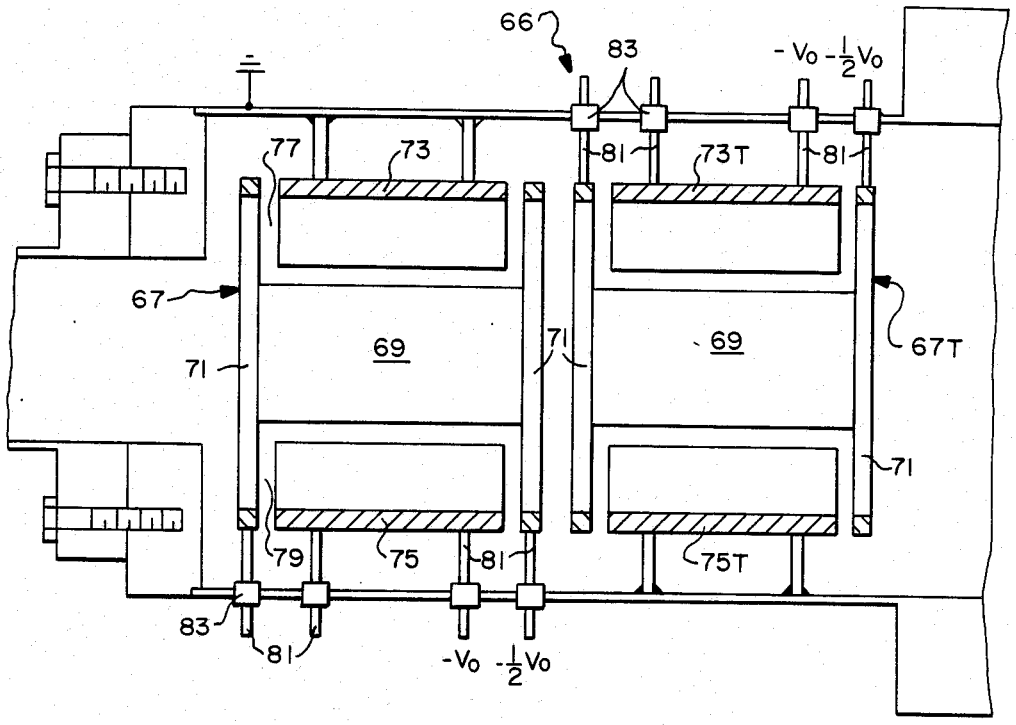

FIG. 3 diagrammatically illustrates the rearward section of a beam chamber forming one embodiment of the assembly illustrated in FIG. 1 and specifically shows the radial expansion of the beam as it travels along the length of the chamber section and the positioning of the ion clearing electrodes of the present invention along the length of the chamber section;

FIG. 4 diagrammatically illustrates the potential along the beam axis for the chamber section illustrated in FIG. 3, and specifically illustrates the negative potential wells which trap positive ions;

FIG. 5 is a longitudinal sectional view of the beam housing illustrated in FIG. 3 taken through an ion clearing electrode structured in accordance with the present invention;

FIG. 6 is a cross-sectional view of the beam housing through the ion clearing electrode illustrated in FIG. 5; and FIG. 7 is a longitudinal sectional view of the beam housing illustrated in FIG. 3 taken through an alternative ion clearing electrode structure in accordance with the present invention.

Referring specifically now to FIG. 3, there is diagrammatically illustrated the upper half of the rearwardmost chamber section 34 of the electron beam production and control assembly 12. The omitted lower half of the chamber is essentially identical to the top half in that the chamber is a stepped cylindrical configuration centered about the beam axis. The chamber section 34 is part of the overall housing 26 which is electrically grounded (maintained at zero potential). The anode and cathode of the electron gun 42 are shown at the rearward end 16 of the chamber section 34. The section of housing 26 defining chamber section 34 includes an inner surface 52 which is circular in cross-section and, as mentioned, defines a progressively outwardly stepped configuration from the rearward end 16 of the chamber section 34 to forward end of section 34 and the entry to control chamber section 36. The expanding envelope of the beam 44 is shown from the point of generation at the electron gun as it traverses through the chamber section 34 toward control section 36.

FIG. 4 illustrates the potential along the electron beam axis through chamber section 34, including axially-spaced potential wells 54 and 56 associated with the steps in chamber surface 52. Because the potential distribution is derived and calculated in the co-pending Rand patent, the details need not be repeated here except to mention that the potential distribution is calculated for beam kinetic energy $T=100$ kV and beam current $I=590$ mA. The positive ions produced by the electron beam 44 as a result of its interaction with residual gas within the beam chamber are characterized by kinetic energies which are very small compared to the $-100$ to $-150$ volt potential wells 54 and 56. Therefore, these positive ions tend to accumulate at the minima of the potential distribution, within the potential wells, and to neutralize the beam. This in turn causes the beam to collapse (reduce in size) before reaching the intermediate, control chamber section 36 and also causes the beam to become less stable if the pressure fluctuates. However, in their undesirable function as loci for trapping the positive ions, the potential wells also provide an advantageous site for locating the ion clearing electrodes so as to remove the trapped ions from the potential wells and from the overall beam itself to thereby reduce and preferably eliminate their neutralizing effect on the beam. Those ions produced near the electron gun 42 fall into the negative potential well 58 formed by a gun ion trap 60, FIG. 3, which does not form a specific part of this invention. Two such ion clearing electrodes generally indicated at 65 and 66 are shown disposed in lateral alignment with the two potential wells 54 and 56, respectively. In essential structural features, the two electrodes are identical. The difference is that electrode 66 is larger in radial dimension to accommodate the larger chamber cross-section and the larger beam envelope cross-section associated with the potential well 56.

Before considering the specific construction of the ion clearing electrodes 65 and 66 and in order to better understand the theory and function of the electrode design, it is helpful to understand some of the relevant electrostatic potential and beam optic theory. The general theory is described at length in the co-pending Rand U.S. patent and need not be repeated here. In the main then, the theory treated here is limited to the specific equations which were developed and used specifically for the present improved ion clearing electrodes such as 65 and 66 and are necessary for understanding of their operation.

In general, for a cylindrical configuration of electrodes with symmetry about the y-axis (see FIG. 6), the electrostatic potential inside the electrode array is of the form:

$$\phi(r,\theta) = \phi_o + \sum_n S_n \left(\frac{r}{R}\right)^n \sin n\theta,\ n = 1,3,5,\text{etc.}$$

where $\phi_o$ is a constant, r, R and $\theta$ are defined in FIG. 6 (R is the electrode radius) and $$S_n = \frac{1}{\pi}\left(\frac{R}{r}\right)^n \int_o^{2\pi} (\phi - \phi_o)\sin n\theta\, d\theta,$$

the integral being evaluated at a fixed radius r. $S_n$ is normally determined by the boundary conditions at r=R, a cylindrical surface of known potential distribution.

Hence, the vertical electric field at $\theta=90°$ and a distance y above the origin is given by $$E_y = E_y(y=o)\left[1 - \frac{3S_3}{S_1}\left(\frac{y}{R}\right)^2 + \frac{5S_5}{S_1}\left(\frac{y}{R}\right)^4 - \ldots\right]. \quad (1)$$

In general, for arbitrary potential distributions around the cylinder forming the electrodes, the orders of magnitude of the quantities $nS_n$ in equation (1) are the same so that the order of magnitude of the coefficient of $(y/R)^{n-1}$ in (1) is unity.

Thus, for typical values R=2.5 centimeter and y=0.5 centimeter (the extreme vertical position of the beam envelope), the magnitude of the electric field would be approximately four percent lower than the on-axis magnitude. This magnitude of field variation is undesirable in that the shape of the beam spot on X-ray target 50 is very sensitive to electric field variation. Even minor variations in the field acting on the electron beam can cause distortions in the electron beam spot and errors in interpreting the X-ray data which are entirely disproportionate to the magnitude of the variation, in large part because the data and interpretation are based upon relatively small, even subtle changes and variations.

The principal culprit which causes the above-described field variation is the $(y/R)^2$ term of equation (1). This square-power term can be eliminated by using the following potential distribution on the electrodes at radius R (see FIG. 6). For values of $\theta$ from $-30°$ to 30° and 150° to 210°, $\phi=\phi_o$=constant; for values of $\theta$ from 30° to 150°, $\phi=\phi_o-v_o/2$ and for values of $\theta$ from 210° to 330°, $\phi=\phi_o+V_o/2$. (End effects are neglected.) This configuration would provide the following expression for the electrostatic potential inside the cylindrical ion clearing electrode array:

$$\phi = \phi_o + \frac{\sqrt{3}\,V_o}{\pi}[\,]$$

where [ ] = (2)

$$\left[\left(\frac{r}{R}\right)\sin\theta - 1/5\left(\frac{r}{R}\right)^5 \sin 5\theta - 1/7\left(\frac{r}{R}\right)^7 \sin 7\theta + \ldots\right],$$

and the preferred value for $\phi_o$ is $-V_o/2$.

The vertical electric field along the y-axis (vertical axis) is then:

$$E_y = -\frac{V_o\sqrt{3}}{\pi R}\left[1 - \left(\frac{y}{R}\right)^4 + \left(\frac{y}{R}\right)^6 - \ldots\right], \quad (3)$$

where the y-axis is defined as pointing from the axis of the system to the center of the grounded electrode, the origin being on the axis. For the typical electrode radius R=2.5 centimeter and y=0.5 centimeter, at the extreme position of the beam envelope, the electric field given by the equation (3) is only about 0.16 percent lower than its value on-axis. This is the direct result of the elimination of the squared term in the bracketed component of equation (3). This field variation is well within tolerance for negligible beam aberrations. To illustrate, for the specified electrode radius and beam radius values, the on-axis field strength is 0.5513 $V_o/R$, whereas at the extreme vertical position of the beam envelope the electrode field strength is about 0.5504 $V_o/R$.

Another critical factor developed at length in the co-pending Rand patent is the equilibrium value of the neutralization fraction f, which is a measure of the effectiveness of the ion clearing electrode in extracting positive ions from the system and thereby decreasing or eliminating neutralization by such ions. For a sufficiently high negative potential on the electrodes, the neutralization fraction is given by:

$$f \simeq \frac{\sigma N_A L \beta}{l} \cdot \frac{4}{3}\left(\frac{Mr_o}{E_v - E_o}\right)^{\frac{1}{2}} \quad (4)$$

where $\sigma$=positive ion production cross-section of the electron beam $N_A$=number of gas atoms per unit volume L=the length of beam from which ions are attracted to region l $\beta$=velocity of electrons/velocity of light l=the length of the region from which ions may be extracted M=ionic mass ($N_2^+$)

$r_o$=classical electron radius $E_v$=electric field due to the ion clearing electrodes, and $E_o$=maximum electric field due to the electron beam.

This equation is valid when $E_o$ is small compared to $E_v$.

The right hand side of equation (4) is directly proportional to the ionization cross-section and the residual gas pressure and inversely proportional to the length, L, of the region from which ions are extracted, and it is inversely proportional to the square root of the electric field. Thus, the neutralization fraction f can be controlled to a suitable low value by increasing the length of the ion clearing electrode along the ion beam axis or by increasing the value of the electric field. Since deflection of the beam which is proportional to l and $E_v$ should be minimized, in order to achieve a sufficiently low value of f, it is better to increase the value of l as in the present invention rather than use a high value of $E_v$.

FIGS. 5 and 6 illustrate schematically in respective longitudinal section and cross-section views an ion clearing electrode assembly (ICE) 65 which embodies features of the present invention.

The ICE 65 is of a generally cylindrical configuration, and is mounted within chamber section 34 so that the electrode axis coincides with the propagation axis of the electron beam and the axis of chamber section 34. The electrode assembly 65 has two opposite center sections 69—69 which comprise substantially equal arcs of the cylinder cross-section and which are substantially the same diameter as, and concentric with, end guard rings 71—71. (In the illustrated embodiment, 69—69 and 71—71 are actually machined from a single cylindrical tube of metal.) The guard rings 71—71 define the opposite ends of the electrode assembly 65. Each center section 69 also spans the distance between the opposite guard rings and is electrically connected in common with the guard rings (being the same piece of metal). ICE assembly 65 also includes upper and lower sections 73 and 75 which are substantially concentric with the guard rings 71—71 and center sections 69—69 and which substantially span the distance between the opposite guard rings and individually substantially span the associated peripheral cylinder distance or arc between the two center sections. The upper and lower cylinder sections are electrically isolated from the center sections and from the guard rings, by insulation and by spacings 77 and 79. The ion clearing electrode assembly 65 can be conveniently formed by cutting or otherwise machining the gaps 77 and 79 in a cylindrical pipe of material such as stainless steel.

In the ion clearing electrode assembly 65, the upper electrode section 73 is connected to the housing 34 and therefore is at system ground potential (i.e., zero); the lower electrode section 75 is at the predetermined electrode voltage such as $-V_o$; and the guard rings and center sections are connected in common to a second, lesser voltage, which is $-V_o/2$.

As shown, the guard rings 71—71 and the lower electrode 75 are connected to feed-through electrodes 81 which extend through the housing 34 and are isolated from the housing by insulation bushings 83 for connection to their respective constant voltages. These voltages can be easily supplied by a common voltage supply operating through a resistive voltage divider network.

As mentioned previously, the primary advantage of the ion clearing electrode 65 of the present invention is that the electric field within the ICE is precisely uniform over the cross-section of the beam. Aberrations of the beam optics are thus made negligible. This improvement results from the geometric design and structure of the present ICE and the multiple voltage levels which are applied thereto. Specifically, the split cylinder design (two sections 69 and sections 73 and 75) is such that the angle of the arc subtended by the center sections 69—69 can be selected to eliminate the $(y/R)^2$ term of equation (1), which is primarily responsible for the non-uniformity inherent in equation (1). As a result, the vertical electric field $E_y$ across the ion clearing electrode obeys equation (3) which provides a more uniform field at the center of the electrodes. The angle of the arcs is 60°, i.e., 30° above and below the X-axis. The split cylinder design also provides for application of the basic voltage $-V_o$ across the ICE via separate sections 73 or 75. (The voltage $-V_o$ is chosen depending on the electron beam current and voltage and the residual gas pressure as described in the co-pending Rand patent.) In addition, the center sections 69—69 are used to apply a selected voltage exactly half-way between $-V_o$ and system ground to achieve the desired uniform field profile across the electron beam. The guard rings 71—71 at each end of the electrode cylinder assemblies substantially reduce the region of field fall-off at each end of the cylindrical electrode, and thereby confine the field region essentially to the electrode. The center sections 69—69 and guard rings 71—71 establish the potential along the beam axis at a constant value inside the electrode. As mentioned, the voltage applied to the end guard rings 71—71 and the center section 69—69 is $-V_o/2$ to thereby ensure that the potential along the beam axis forms a potential well at constant potential $-V_o/2$.

It should be noted that while other angles and voltages which individually approximate those given here may approximate the desired field uniformity, the precise 30° angle and the particular voltage relationships are required to achieve the best field uniformity.

In short, because of the split configuration, the 30° arcs, and the particular voltage relationships, equation (3) describes the vertical electric field on the y-axis within ICE 65. For the previously mentioned exemplary dimensions of y=0.5 centimeter and R=2.5 centimeter, the vertical field $E_y$ varies only 0.16 percent from the beam axis to the vertical extremes of the beam envelope, in any cross-sectional plane along the beam axis within the electrode.

Thus, as is true of the ICE introduced in the co-pending Rand patent, ion clearing electrode 65 removes positive ions and stabilizes the electron beam against pressure fluctuations and additionally achieves near-perfect field uniformity and thus negligible aberrations of the beam optics.

In addition, the split cylinder design of the ion clearing electrode of the present invention permits the use of tandem electrode assemblies to eliminate beam deflection by the overall ion clearing electrode assembly. Also, (and in part because of the elimination of deflection), the present ion clearing electrode provides increased flexibility in the choice of the parameters used to control the neutralization fraction, f, in that increasing the length, l of the ICE is now a very viable option.

Consider first the elimination of beam deflection. In general, the potential applied across ion clearing electrodes such as 65 ($-V_o$ on one side; ground on the other) deflects the beam albeit very slightly. The deflection is a function of length, however, so that increasing the length increases the deflection. Referring to FIG. 7, the ion clearing electrode assemblies of the present invention can be employed in pairs which have offsetting deflection characteristics and thus eliminate any overall beam deflection. The tandem ion clearing electrode assembly 66 of FIG. 7 comprises two aligned co-axial tandem cylindrical electrode assembly sections 67 and 67T. The electrode cylinder assemblies 67 and 67T are essentially identical to ion clearing electrode 65. The electrode cylinder assemblies 67 and 67T need not be of the same size and a step in the beam housing may be located between them, but to produce cancelling deflections the ratio of length to radius must be the same in both. The split cylinder design of electrode cylinder assemblies 67 and 67T and the voltage symmetry thereof are such that the voltage relationships of the sections 73T and 75T of assembly 67T can be interchanged relative to the sections 73 and 75 of assembly 67. That is, for example, sections 73 and 75 of electrode assembly 67 are at system ground and $-V_o$, whereas sections 73T and 75T of electrode assembly 67T are at $-V_o$ and system ground, respectively. Typically, the center sections 69—69 and end guard rings 71—71 of both electrode assemblies are at $-V_o/2$. Then, if the assemblies are of equal length to radius ratio, assembly 67T will provide an equal, oppositely-directed deflection to the beam which exactly offsets the deflection provided by assembly 67. In consequence, the oppositely-directed deflections eliminate any overall deflection and the exit path of the electron beam from the ion clearing electrode is parallel to the incident path with only a small offset or displacement.

The paired ion clearing arrangement is not limited to the adjacent arrangement shown in FIG. 7. It is equally applicable, for example, to spatially separate ion clearing electrodes such as electrodes associated with potential wells 54 and 56, FIG. 4. Single electrodes 65 positioned at each potential well and having the described reversed voltage across sections 73 and 75 will eliminate net deflection across this pair of electrodes.

In considering the resultant ability to use the length of the ICE to control the neutralization fraction, f, please refer again to equation (4). As mentioned, the neutralization fraction f is inversely proportional to l (the length of the region from which ions may be extracted from the electron beam) and is inversely proportional to $E_v^{\frac{1}{2}}$ (if $E_v >> E_o$), the square root of the electric field due to the ion clearing electrode. Thus, the overall lack of deflection of the electron beam provided as described above permits tailoring the value of l and/or $E_v$ to achieve the desired magnitude of the neutralization function, f, independent of the individual deflections. Also, since f is inversely proportional to l, but inversely proportional to only the square root of $E_v$, a given percentage increase in l tends to be substantially more effective than the same percentage increase in $E_v$. By increasing l, it is possible to maintain the same magnitude of f using a lower voltage $E_v$. Alternatively, one can use the same voltage $E_v$ and use the increase in l to provide a lower neutralization fraction f. In fact, a sufficiently small neutralization fraction f is relatively easy to attain using the ion clearing electrode 65 and, as a result, l can be increased in order to provide a lower voltage $E_v$. This is precisely what is done in the illustrated embodiment of the ICE 65, where length l=5.0 centimeter permits $E_v$ of −400 volt or less, as compared to the value of at least −600 volt which was used typically in the ICE introduced in the co-pending Rand patent. Preferably, the overall length of the ion clearing electrode 65 is approximately equal to at least the diameter of the electrode for the reason that in general this contributes to field uniformity.

Thus, there has been described an ion clearing electrode which provides the desired extraction of positive ions at selected potential minima or wells along the electron beam axis and stabilizes the beam against pressure fluctuation, while maintaining an essentially perfectly uniform electric field perpendicular to the axis of the electron beam. Also, due to the geometric design and voltage combination of the electrode, the field uniformity is relatively unaffected by the length of the ion clearing electrode. The length of the electrode thus can be tailored to establish a desired low value of the neutralization fraction f at a relatively low value of the electrode potential, $-V_o$. Except as noted, the exemplary dimensions, voltage values and other parameters are given by way of example and not limitation.

Those skilled in the art based upon the present teachings can determine the number, location, dimensions and voltages of the ion clearing electrodes necessary to remove ions from the potential wells of a given electron beam dependent upon the position and magnitude of the potential wells. In addition, the reader will appreciate that the terminology used herein and in the claims, such as "middle", "upper" and "lower" electrode sections, denotes physical positioning relative to the other parts of the electrode and is not intended to limit the orientation of the ion clearing electrode. The ICE can be rotated so that the internal upper and lower orientation does not hold for orientation relative to the external world.

I claim:

1. An electrode for removing ions from an electron beam having a beam envelope, and propagating along an axis, the electrode being of substantially cylindrical configuration and extending substantially co-axially with the electron beam and comprising: a pair of end rings and four lengthwise-extending cylinder sections each spanning predetermined arcs of the cylinder periphery; oppositely positioned first and second such cylinder sections being electrically isolated from one another and from the end rings and the third and fourth such sections; the end rings being electrically connected in common with the third and fourth cylinder sections; and the resulting electrically separate entities being connected to voltages of predetermined values to provide removal of positive ions from the electron beam and at the same time provide a uniform electric field across the cross-section of the beam envelope.

2. The electrode of claim 1 wherein the third and fourth cylinder sections each comprise 60° of arc to thereby provide a precisely uniform electric field across the cross-section of the electron beam.

3. The electrode of claim 1 wherein the predetermined voltage level of the third and fourth cylinder sections defines a uniform on-axis voltage level, and the end rings confine the electric field substantially within the electrode.

4. The electrode of claim 3 wherein the third and fourth cylinder sections and the end rings are at the same voltage.

5. The electrode of claim 1 wherein the electrode is adapted to be positioned at a potential well of the electron beam and wherein the first and second cylinder sections are connected respectively at system ground and at a predetermined voltage of absolute magnitude greater than the absolute magnitude of the associated potential well.

6. The electrode of claim 5, further comprising a second said electrode positioned co-axially in tandem with said first electrode and wherein the first and second cylinder sections of said second electrode are connected, respectively, to the predetermined voltage and to system ground.

7. An electrode for removing ions from an electron beam having a beam envelope and propagating along an axis, the electrode being of substantially cylindrical configuration and extending substantially co-axially with the electron beam and comprising: a pair of end rings and four lengthwise-extending cylinder sections each spanning predetermined arcs of the cylinder periphery; oppositely positioned first and second such cylinder sections being electrically isolated from one another and from the end rings and the third and fourth such sections; the end rings being electrically connected in common with the third and fourth cylinder sections; and the resulting electrically separate entities being connected to voltages of selected values to thereby provide highly effective removal of positive ions from the electron beam and at the same time provide a uniform electric field across the cross-section of the beam: envelope, the vertical electric field on the y-axis in the electrode being $$E_y = -\frac{V_o\sqrt{3}}{\pi R}\left[1-\left(\frac{Y}{R}\right)^4+\left(\frac{Y}{R}\right)^6-\dots\right],$$

wherein the y-axis is vertical, perpendicular to the axis of the electrode and passes through the centers of the first and second cylinder sections, y is the distance along the y-axis, $V_o$ is an ion-extraction voltage applied to the first or second cylinder section and R is the radius of the electrode.

8. The electrode of claim 7 wherein the third and fourth cylinder sections each comprise 60° of arc to thereby provide a precisely uniform electric field across the cross-section of the electron beam.

9. The electrode of claim 7 wherein the predetermined voltage level of the third and fourth cylinder sections defined a uniform on-axis voltage level and the end rings confine the electric field substantially within the electrode.

10. The electrode of claim 7 wherein the electrode is positioned at a potential well of the electron beam and wherein the first and second cylinder sections are connected, respectively, at system ground and at $-V_o$, $-V_o$ being a predetermined negative voltage of absolute magnitude greater than the absolute magnitude of the associated potential well.

11. The electrode of claim 10 wherein the absolute magnitudes of the relative voltages on the electrode components are

| | |
|---|---|
| first cylinder section: | system ground |
| second cylinder section (negative voltage): | $V_o$ |
| end rings and third and fourth sections (negative voltage): | $V_o/2$. |

12. The electrode of claims 10 or 11, further comprising a second said electrode positioned co-axially in tandem with said first electrode and wherein the first and second sections of said second electrode are connected respectively at the predetermined voltage and at system ground.

13. An improved ion clearing electrode for extracting ions from an electron beam propagated within a vacuum chamber and for providing a uniform electric field across the cross-section of the beam, comprising: at least a first cylinder assembly extending substantially co-axially with the electron beam comprising four sections extending substantially the length thereof; a first pair of first and second of such sections defining substantially equal arcs of the cylinder cross-section on opposite sides thereof; a second pair of third and fourth of such sections lying on opposite sides of the cylinder axis and each spanning substantially equal arcs between the first pair of sections; and a pair of circular rings defining opposite ends of the cylinder assembly; the end rings forming an electrically common arrangement with the third and fourth cylinder sections, and said first and second sections being electrically isolated from one another and from said electrically common arrangement; the first and second sections and said electrically common arrangement being adapted to receive respective voltages to provide a substantially uniform electric field within said first cylinder assembly across the cross-section of the electron beam.

14. The improved ion clearing electrode of claim 13 further comprising a second said electrode cylinder assembly co-axial with the first, the first and second electrode sections of said second assembly being electrically connected in common, respectively, with the second and first sections of said first electrode assembly to thereby eliminate deflection in the beam path exiting said ion clearing electrode relative to the beam entrance path thereto, and whereby the combined axial length of said ion clearing electrode is preselected to provide a given level of ion extraction from the electron beam.

15. The improved ion clearing electrode of claim 14 wherein each of said third and fourth sections spans approximately 60° of arc and wherein the predetermined voltages applied to said first electrode cylinder assembly are

| | |
|---|---|
| first section: | system ground |
| second section: | $-V_o$ |
| third and fourth sections and end rings: | $-V_o/2$, |

and those applied to said second electrode cylinder assembly are

| | |
|---|---|
| first section: | $-V_o$ |
| second section: | system ground |
| third and fourth sections and end rings: | $-V_o/2$, where $V_o$ is selected for ion extraction. |

16. An improved ion clearing electrode for extracting ions from an electron beam propagated within a vacuum chamber and maintaining electric field uniformity across the beam, comprising: at least a first generally cylindrical ion clearing electrode structure substantially co-axial with the envelope of the electron beam, said first cylindrical structure comprising a pair of substantially circular end rings defining the opposite ends thereof; a pair of first and second cylinder sections substantially spanning the distance between the end rings and being substantially concentric with the associated end rings and defining substantially equal arcs; the end rings being electrically connected to a pair of cylinder center sections spanning the distance between the end rings on opposite sides of the beam axis and each spanning 60° of the arc of the associated end rings and being substantially concentric with the associated end rings; and wherein the first section, the second section, and the electrically connected center sections and end rings are adapted for receiving respective predetermined voltages such that the vertical electric field $E_y$ on the y-axis in the ion clearing electrode is given by:

$$E_y = -\frac{V_o\sqrt{3}}{\pi R}\left[1-\left(\frac{Y}{R}\right)^4+\left(\frac{Y}{R}\right)^6-\cdots\right],$$

where the y-axis is vertical, perpendicular to the axis of the ion clearing electrode and passes through the centers of the first and second cylinder sections, y is the distance along the y-axis, R is the radius of the ion clearing electrode, and the magnitude of $V_o$ is selected for ion extraction, and wherein the voltages on (1) the first section, (2) the second section and (3) the center sections and end rings are respectively (1) system ground, (2) $-V_o$ and (3) $-V_o/2$.

17. The improved ion clearing electrode of claim 16 further comprising a second said cylindrical electrode structure adjacent said first cylindrical electrode structure and co-axial therewith.

18. The improved ion clearing electrode of claim 17 wherein the predetermined voltages applied to said second cylindrical electrode structure on (1) the first section, (2) the second section and (3) the center sections and end rings are respectively (1) $-V_o$, (2) system ground and (3) $-V_o/2$.

19. An improved ion clearing electrode assembly for extracting ions from an electron beam propagated within a vacuum chamber and for maintaining electric field uniformity across the beam, the electrode assembly comprising first and second cylinder assemblies substantially co-axial with the electron beam, each said cylinder assembly comprising at least four corresponding sections extending substantially the length of each said assembly; the first and second sections thereof lying on opposite sides of the cylinder and each spanning substantially the associated cylinder arc between third and fourth sections; the third and fourth such sections each defining approximately 60° arcs of the cylinder on opposite sides thereof; and at least a pair of circular end rings defining opposite ends of the cylinder assembly; the end rings forming an electrically common arrangement with the third and fourth cylinder sections, and the first and second cylinder sections being electrically isolated from one another and from said electrically common arrangement; and wherein the first and second electrode sections and the electrically common arrangement are adapted for receiving respective predetermined voltages such that the vertical electric field $E_y$ on the y-axis (vertical axis) in the first cylinder assembly is given by:

$$E_y = -\frac{V_o\sqrt{3}}{\pi R}\left[1-\left(\frac{y}{R}\right)^4+\left(\frac{y}{R}\right)^6-\cdots\right],$$

wherein y is the distance along the y-axis; R is the radius of the ion clearing electrode; the magnitude of $V_o$ is selected for ion extraction; the vertical electrical field $E_y$ on the y-axis of the second cylinder assembly is given by the above expression, with the sign thereof being reversed; and wherein the predetermined voltages applied to said first cylinder assembly are

| | |
|---|---|
| first section: | system ground |
| second section: | $-V_o$ |
| common assembly: | $-V_o/2$, |

and those applied to said second cylinder assembly are

| | |
|---|---|
| first section: | $-V_o$ |
| second section: | system ground |
| common assembly: | $-V_o/2$. |

* * * * *